US005468264A

United States Patent [19]

DeRosa et al.

[11] Patent Number: 5,468,264

[45] Date of Patent: Nov. 21, 1995

[54] NON-METALLIC ANTI-KNOCK FUEL ADDITIVE

[75] Inventors: Thomas F. DeRosa, Passaic, N.J.; William M. Studzinski, Beacon, N.Y.; Joseph M. Russo, Poughkeepsie, N.Y.; Benjamin J. Kaufman, Hopewell Junction, N.Y.; Robert T. Hahn, Beacon, N.Y.

[73] Assignee: Texaco Inc., White Plains, N.Y.

[21] Appl. No.: 332,685

[22] Filed: Nov. 1, 1994

[51] Int. Cl.[6] ..... C10L 1/22

[52] U.S. Cl. ..... 44/426; 44/431

[58] Field of Search ..... 44/426, 429, 431, 44/432; C10L 1/22

[56] References Cited

U.S. PATENT DOCUMENTS 2,662,815 12/1953 Rudel ..... 44/426

OTHER PUBLICATIONS

Patent Application D#79,998, Ser. No. 08/308,890 DeRosa et al.

*Primary Examiner*—Prince Willis, Jr.

*Assistant Examiner*—Cephia D. Toomer

*Attorney, Agent, or Firm*—George J. Darsa; Kenneth R. Priem; Christopher Nicastri

[57] ABSTRACT

A gasoline fuel composition comprising a major portion of gasoline and a minor portion of one or more polyaryl amines, effective to increase the octane number of the gasoline composition, represented by the formula:

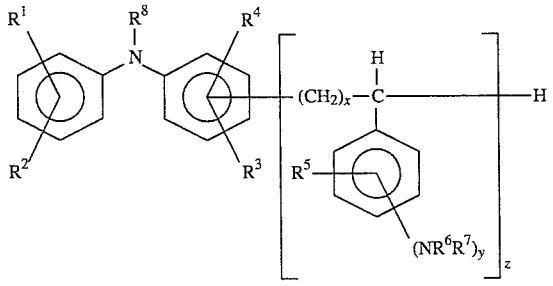

where $R^1$–$R^5$ are independently hydrogen or $C_1$–$C_8$ aliphatic hydrocarbons; $R^6$–$R^8$ are independently hydrogen or $C_1$–$C_6$ aliphatic hydrocarbons; x is between 0 and about 2, inclusive, y is between 0 and about 3, inclusive; and z is between about 1 and about 50, inclusive.

14 Claims, No Drawings

NON-METALLIC ANTI-KNOCK FUEL ADDITIVE

BACKGROUND OF THE INVENTION

1. Field of the Invention

The present invention relates to a gasoline with improved octane number. More specifically, the present invention relates to a non-metallic aliphatic polyaryl hindered aryl amine anti-knock fuel additive.

2. Description of Related Information

Spark initiated internal combustion gasoline engines require fuel of a minimum octane level which depends upon the design of the engine. If such an engine is operated on a gasoline which has an octane number lower than the minimum requirement for the engine, "knocking" will occur. Generally, "knocking" occurs when a fuel, especially gasoline, spontaneously and prematurely ignites or detonates in an engine prior to spark plug initiated ignition. It may be further characterized as a non-homogeneous production of free radicals that ultimately interfere with a flame wave front. Gasolines can be refined to have sufficiently high octane numbers to run today's high compression engines, but such refining is expensive and energy intensive. To increase the octane level at decreased cost, a number of metallic fuel additives have been developed which, when added to gasoline, increase its octane rating and therefore are effective in controlling engine knock. Although the exact mechanism is unknown, the effectiveness of these metallic agents is believed to entail deactivation of free radical intermediates generated during combustion. The problem with metallic anti-knock gasoline fuel additives, however, is the high toxicity of their combustion products. For example, the thermal decomposition of polyalkyl plumbates, most notably tetramethyl- and tetraethyl lead, are lead and lead oxides. All of these metallic octane improvers have been banned nationwide in motor gasolines, because their oxidation products produce metallic lead and a variety of lead oxides. Lead and lead oxides are potent neurotoxins and, in the gaseous form of an automotive exhaust, become highly neuro-active.

It would therefore be desirable to identify non-metallic anti-knock agents which would produce little toxic combustion products compared to metallic anti-knock agents, and which would provide a needed increase in octane ratings to eliminate "knocking".

SUMMARY OF THE INVENTION

In accordance with certain of its aspects, the present invention provides a gasoline composition comprising a major portion of a mixture of hydrocarbons boiling in the gasoline boiling range and a minor portion of one or more aliphatic polyaryl amines, effective to increase the octane number of the gasoline composition, represented by the formula:

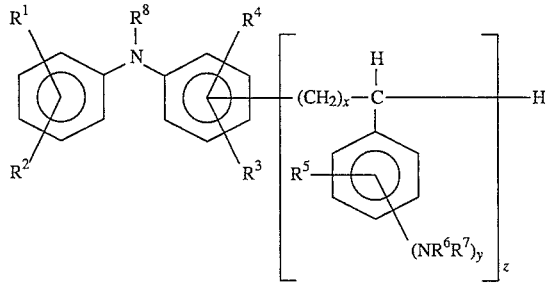

where $R^1$–$R^5$ are independently hydrogen or $C_1$–$C_8$ aliphatic hydrocarbons; $R^6$–$R^8$ are independently hydrogen or $C_1$–$C_6$ hydrocarbons; x is an integer between about 0 and about 2, inclusive, and y is an integer between about 0 and about 3, inclusive; and z is an integer ranging from 1 to 50.

In a second embodiment, the present invention provides a method of improving the octane number of a gasoline which comprises adding to a major portion of gasoline, a minor, octane improving portion of the polyaryl amine described above.

DETAILED DESCRIPTION OF THE INVENTION

We have found that the anti-knock gasoline fuel additives of the present invention provide significant increases in octane number for gasoline compositions, without producing metallic pollutants.

The anti-knock gasoline fuel additive of the present invention comprises one or more polyaryl amines represented by the formula:

Formula I

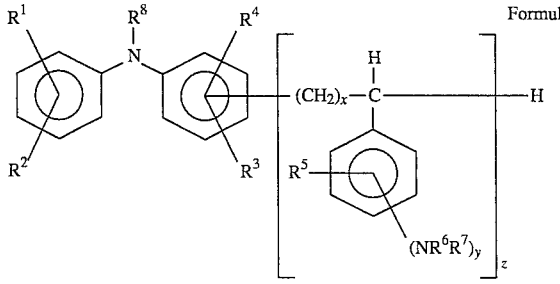

where:

$R^1$–$R^5$ are independently hydrogen or $C_1$–$C_8$ aliphatic hydrocarbons. In a typical embodiment $R^1$–$R^5$ are independently hydrogen or $C_4$–$C_8$ aliphatic hydrocarbons. In another embodiment, $R^1$ is a $C_4$–$C_8$ aliphatic hydrocarbon radical, while $R^2$–$R^5$ are hydrogen. In this embodiment, the additive would comprise one or more compounds of Formula I, with $R^1$ representing one or more of hydrogen or $C_4$–$C_8$ aliphatic hydrocarbon radicals;

$R^6$–$R^8$ are independently hydrogen or $C_1$–$C_6$ hydrocarbons. In a preferred embodiment, $R^6$–$R^8$ represent hydrogen;

x is an integer between about 0 and about 2, inclusive. Preferably x is 1;

y is an integer between about 0 and about 3, inclusive. Preferably y is 0; and z is an integer between about 1 and about 50, inclusive. In cases where z greater than about 50, the material becomes too resinous and will cause engine fouling.

Preferably, z is a number from about 1–about 3.

Formula I is intended to indicate that groups $R^1$–$R^5$ and the —$NR^6R^7$ group can be of any spacial orientation.

The polyaryl amines of the present invention can be prepared in any manner known to those skilled in the art. Typically, they can be prepared as follows:

Equation I

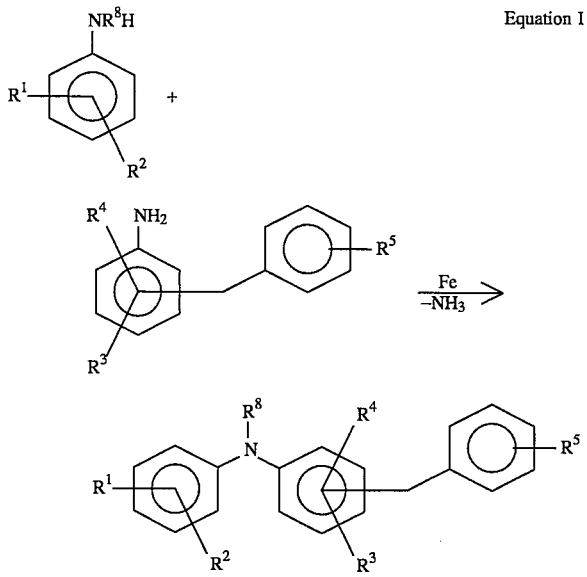

where the polyaryl intermediate is generated by the Lewis acid condensation of an alkyl benzylic intermediate and an alkyl aniline:

Equation II

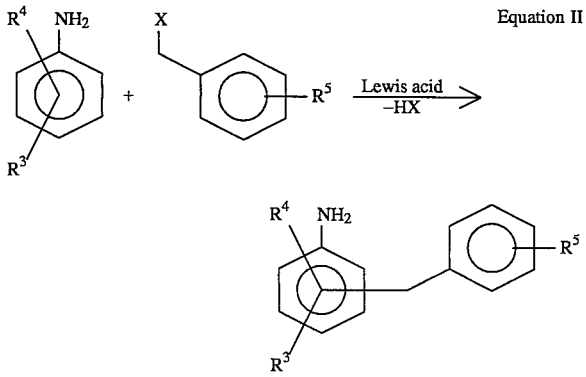

Although Equation I depicts the case where x=1, y=0, and z=1, this basic reaction scheme, i.e., reaction in the presence of an iron catalyst, can be used to produce the additive of the present invention for any allowable values of x, y and z. Similarly, the reaction scheme of Equation II can be used to produce the necessary intermediate for any allowable values of x, y and z.

One preferred mixture of polyaryl amines which can be employed as the anti-knock agent of the present invention is commercially available under the name Naugalube-680™, available from Uniroyal, Inc. of Naugatuck, Conn. The major component of Naugalube-680™ is a mixture of polyaryl amines depicted in Formula II:

Formula II

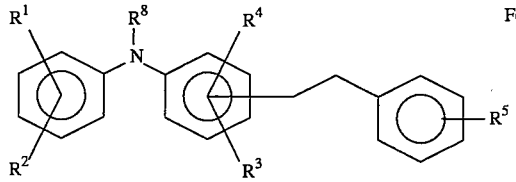

where $R^1$ is a mixture of $C_4$–$C_8$ aliphatic hydrocarbon radicals, and $R^2$–$R^8$ are hydrogen.

The anti-knock agent of the present invention is typically employed in a minor octane increasing amount. It may be added in an amount between 0.01 and 50 wt. %, preferably between 0.01 and 5 wt. % and more preferably between about 0.5 and about 2.0 wt. %. The additive can be blended in to the gasoline by any method, because these polyaryl amines show favorable solubility in hydrocarbon solvents.

The gasolines which can be treated by the process of this invention to raise their octane number boil in the range between about 50° F. and about 450° F., and may be straight run gasolines, but more preferably they will be blended gasolines which are commercially available. An example of a typical gasoline useful in the practice of the present invention is provided in Table I.

TABLE I

| Typical Gasoline | |
|---|---|
| IBP | 80.7° F. |
| 5% | 111.9° F. |
| 10% | 124.5° F. |
| 20% | 141.4° F. |
| 30% | 159.4° F. |
| 40% | 182.3° F. |
| 50% | 207.6° F. |
| 60% | 230.9° F. |
| 70% | 251.2° F. |
| 80% | 277.5° F. |
| 90% | 320.3° F. |
| 95% | 347.1° F. |
| FBP | 417.2° F. |
| RECOVERY | 99.2 vol. % |
| LOSS | 0.1 vol. % |
| RESIDUE | 0.7 vol. % |

These commercial gasolines typically contain components derived from catalytic cracking, reforming, isomerization, etc. Although the octane number of any gasoline may be improved by the technique of this invention, it is preferred to treat charge gasolines of nominal octane number between 75–95. The gasolines may contain other common additives for the improvement of detergency, emissions, dispersancy, corrosion resistance, anti-haze, etc.

It is a feature of the additized gasoline compositions of the present invention that they exhibit increased motor octane number (MON) and research octane number (RON). The experimental engine parameters that distinguish MON from RON are summarized in Table II.

TABLE II

| RON v. MON Experimental Conditions | RON Light Duty; Original CFR | MON Heavy Duty; New CFR |
|---|---|---|
| Engine speed, rpm | 600 | 900 |
| Intake air temperature, °F. | 125 | 100 |

TABLE II-continued

| | RON v. MON Experimental Conditions | |
|---|---|---|
| | RON Light Duty; Original CFR | MON Heavy Duty; New CFR |
| Mixture temperature, °F. | not controlled | 300 |
| Spark advance | for maximum power (later 13°) | automatic* |

*Changes automatically with compression ratio; basic setting is 26° before top center at 5:1 compression ratio.

A six component reference gasoline blend, shown in Table III was used to test the additives of the invention.

TABLE III

| Reference Gasoline Blend | |
|---|---|
| Compound | Amount (wt. %) |
| isopentane | 30 |
| n-heptane | 10 |
| i-octane | 5 |
| n-dodecane | 7 |
| toluene | 25 |
| i-butylbenzene | 10 |

In Examples I and II, 2.0 wt. % of the preferred additive of the present invention, represented by Formula II, above, was added to the experimental gasoline composition described above. In Example I, two samples of the base fuel and the base fuel plus the additive of the present invention were tested for research octane number repeatability, using ASTM D2700. The results are presented in Table IV. Likewise, in Example II, two samples of the base fuel and the base fuel plus the additive of the present invention were tested for motor octane number repeatability, using ASTM D2699. The results are presented in Table V.

TABLE IV

| Example I Sample | Experimental Base Fuel RON | Experimental Base Fuel plus 2.0 wt. % polyaryl amine mixture RON |
|---|---|---|
| 1 | 81.5 | 84.0 |
| 2 | 81.8 | 83.0 |
| 3 | 81.5 | 82.7 |
| 4 | 81.5 | 83.0 |
| 5 | 81.5 | 83.3 |
| Average | 81.6 | 83.2 |

TABLE V

| Example II Sample | Experimental Base Fuel MON | Experimental Base Fuel plus polyaryl amine mixture MON |
|---|---|---|
| 1 | 72.7 | 75.4 |
| 2 | 73.1 | 75.0 |
| 3 | 73.3 | 75.5 |
| 4 | 73.5 | 75.3 |
| 5 | 73.3 | 75.3 |
| Average | 73.2 | 75.3 |

Thus, at a concentration of 2.0 wt. %, the additive of the present invention provides a significant average RON increase of 1.6 units and a significant average MON increase of 2.14 units. It provides this octane increase without recourse to metallic anti-knock additive agents.

We claim:

1. A gasoline composition comprising a major portion of gasoline and a minor portion of one or more polyaryl amines, effective to increase the octane number of the gasoline composition, represented by the formula:

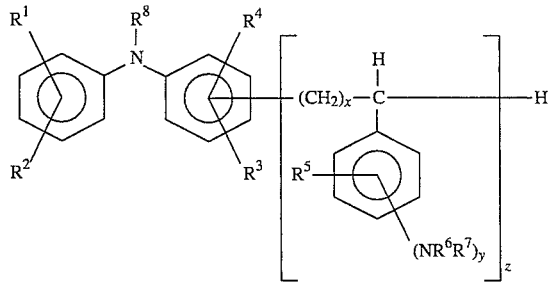

where $R^1$–$R^5$ are independently hydrogen or $C_1$–$C_8$ aliphatic hydrocarbons; $R^6$–$R^8$ are independently hydrogen or $C_1$–$C_6$ aliphatic hydrocarbons; x is between 0 and about 2, inclusive, and y is between 0 and about 3, inclusive; and z is between about 1 and about 50, inclusive.

2. The gasoline composition of claim 1 where x is 0 or 1.

3. The gasoline composition of claim 1 where y is 0 or 1.

4. The gasoline composition of claim 1 where z is from 1 to about 5.

5. The gasoline composition of claim 1 where $R^1$ is a $C_4$–$C_8$ aliphatic hydrocarbon radical, $R^2$–$R^5$ and $R^8$ are hydrogen, and x=1, y=0 and z=1.

6. The gasoline composition of claim 1 wherein the one or more polyaryl amines comprise 0.01 to 5 wt. % of the gasoline composition.

7. The gasoline composition of claim 1 wherein the one or more polyaryl amines comprise about 0.5 to about 2 wt. % of the gasoline composition.

8. A method of improving the octane number of a gasoline which comprises adding to a major portion of gasoline, a minor, octane improving portion of one or more polyaryl amines, represented by the formula:

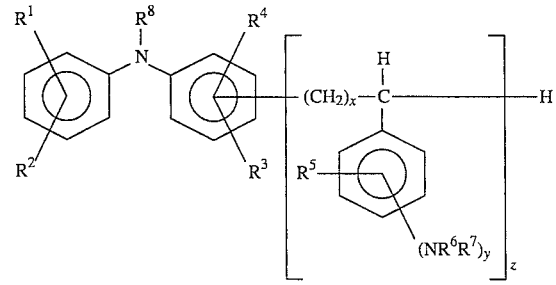

where $R^1$–$R^5$ are independently hydrogen or $C_1$–$C_8$ aliphatic hydrocarbons; $R^6$–$R^8$ are independently hydrogen or $C_1$–$C_6$ aliphatic hydrocarbons; x is between 0 and 2, inclusive, and y is between 0 and about 3, inclusive; and z is between about 1 and about 50, inclusive.

9. The method of claim 8 wherein the one or more polyaryl amines are added in an amount comprising 0.01 to 5 wt. % of the gasoline composition.

10. The method of claim 8 wherein the one or more polyaryl amines are added in an amount comprising about 0.5 to about 2 wt. % of the gasoline composition.

11. The method of claim 8 where x is 0 or 1.

12. The method of claim 8 where y is 0 or 1.

13. The method of claim 8 where z is between about 1 and about 5, inclusive.

14. The method of claim 8 where $R^1$ is a $C_4$–$C_8$ aliphatic hydrocarbon radical, $R^2$–$R^5$ and $R^8$ are hydrogen, and x=1, y=0 and z=1.

* * * * *